United States Patent [19]

Flaming

[11] Patent Number: 5,039,005

[45] Date of Patent: Aug. 13, 1991

[54] CONTAINER AND METHOD FOR MANUFACTURE THEREOF

[75] Inventor: Max L. Flaming, Fresno, Calif.

[73] Assignee: Maxco Supply, Inc., Reedley, Calif.

[21] Appl. No.: 456,745

[22] Filed: Dec. 26, 1989

[51] Int. Cl.[5] ..... B65D 5/42

[52] U.S. Cl. ..... 229/162; 206/45.31; 229/125.39; 493/116; 493/382; 493/905

[58] Field of Search ..... 206/45.31, 45.34; 229/23 R, 162, 125.34, 125.39, 915, DIG. 11; 493/116, 117, 382, 905

[56] References Cited

U.S. PATENT DOCUMENTS

| | | | |
|---|---|---|---|
| 1,865,159 | 6/1932 | Adamson . | |
| 2,126,106 | 8/1938 | Goldberg | 229/162 |
| 2,704,180 | 3/1955 | Goebel et al. | 229/162 |
| 2,721,689 | 10/1955 | Nye . | |
| 3,015,431 | 1/1962 | Mulcoy . | |
| 3,190,535 | 6/1965 | Nute | 229/DIG. 11 |
| 3,434,648 | 3/1969 | Du Barry, Jr. | 229/23 R |
| 3,704,823 | 12/1972 | Howe | 229/162 |
| 3,767,109 | 10/1973 | Paige . | |
| 3,878,980 | 4/1975 | Crane . | |
| 3,905,541 | 9/1975 | Paxton . | |
| 4,142,665 | 3/1979 | Jewell et al. . | |
| 4,175,691 | 11/1979 | Cornell et al. | 229/23 R |
| 4,245,773 | 1/1981 | Stollberg . | |
| 4,291,830 | 9/1981 | Sorensen . | |
| 4,304,353 | 12/1981 | Stollberg . | |
| 4,497,408 | 2/1985 | Jes | 229/23 R |

*Primary Examiner*—Gary E. Elkins

*Attorney, Agent, or Firm*—Worrel & Worrel

[57] ABSTRACT

A container having a housing enclosing an internal compartment and having a wall bounding the compartment with an opening therein and a substantially transparent band for extending across the opening for retaining the container in a sealed condition after filling while permitting viewing of the contents of the compartment through the band. A method for the manufacture of a container including the steps of forming a pair of end walls by adhesively bonding a plurality of corrugated panels in facing relation to each other to form the end walls with the flutes thereof disposed in substantially parallel relation to each other; sawing the end walls to form end walls having end surfaces substantially normal to the panels; positioning the end walls in spaced, substantially parallel relation; extending a wrapper having lid portions about the end walls in adhesive attachment thereto with the lid portions movable between opened positions for filling the container and closed positions having portions disposed in spaced relation to each other to define an opening; and, after filling the container as formed, sealing the container by extending a substantially transparent strip of tape across the lid portions and the opening to retain them in the closed positions and forming a window for viewing the contents of the container through the opening.

19 Claims, 2 Drawing Sheets

CONTAINER AND METHOD FOR MANUFACTURE THEREOF

BACKGROUND OF THE INVENTION

1. Field of the Invention

The present invention relates to a container and method for manufacture thereof and more particularly to such a container and method which result in a container which obviates the problems associated with conventional containers including the impossibility of examining the contents of such conventional containers without damaging them, the collapsing of palletized stacks of containers while in cold storage, the difficulty in interfitting containers within the stacks thereof and a multiplicity of other problems incident to the manufacture and use of associated with conventional containers.

2. Description of the Prior Art

The use of containers of a variety of types employed in the packing, shipping and storage of fungible goods, and particularly perishable goods such as fresh fruit, fresh vegetables and the like, is compromised by problems inherent in the manufacture and use of such containers. In the packing of perishable goods such as fresh fruit and fresh vegetables, millions of containers of a variety of types are employed each season. The cost of containers must be balanced against their dependability in use and this has resulted in the production and use of containers of a host of different designs and construction materials. Since the containers are disposable, one of the most cost efficient construction materials has been corrugated cardboard or fiberboard. Such containers typically consist of a pair of end panels about which is folded a wrapper whose end portions form top panels or lid portions for the container and are sealed into position using a suitable adhesive. The most common form of adhesive presently in use in the fabrication of conventional containers is known as a "hot melt" adhesive which is applied mechanically. While methods and apparatuses for applying such adhesive work adequately in normal operation, they are subject to a host of difficulties including maintaining the heat of the adhesive at the appropriate temperature, avoiding plugging of the dispensing mechanisms, uneven application and the like.

Such conventional containers may be shipped to the end user, or packer, in flattened blanks and assembled mechanically in the plant just prior to packing, or may be assembled by the box manufacturer leaving the lid portions open for packing and sealing by the packer. In any case, the above noted problems with hot melt adhesives are experienced by the packer in sealing the containers once packed. Such adhesives are normally applied to the side flaps of the lid portions of the container and mechanically folded downwardly into engagement with the side walls as the filled containers are transported along an assembly line. In a sealed container, the juxtaposed marginal edges of the lid portions are typically not adhesively bonded and therefore serve as an entry point for dust, dirt, pests and the like as well as presenting a convenient gripping point for ripping the containers open in unauthorized entry. Furthermore, the strength of the container is compromised by such construction. Upon receipt at the point of destination after shipping, there is no way for the contents of the container to be examined without inflicting permanent damage to the container.

Another problem with containers of this type becomes apparent when the containers are stacked, as is the conventional practice, for storage and shipment. This problem is particularly acute where such containers are stacked in cold storage. The combined weight of the stacked containers causes them individually to collapse under load crushing some or all the contents of the containers and the stack ultimately to lose its integrity. It is not uncommon for palletized stacks to collapse in storage resulting in the substantial or total loss of the contents thereof. The moisture in the humid environment to which such stacks of containers are exposed in cold storage is absorbed by the containers over time causing the corrugated cardboard to lose its rigidity and fail in the manner described. Since typically such prior art containers are formed by folding along score lines, cutting of panels along courses and other such conventional assembly processes, the flutes of the corrugations are frequently crushed, flattened, or otherwise weakened so that the resulting containers are frequently of weakened and irregular configurations, particularly on the folded portions which constitute the load bearing portions of the containers. In stacks of such containers, the irregular load bearing portions, weakened side walls, and the absorption of moisture all contribute to structural failure.

In an effort to enhance the integrity of stacks of such containers, it has been known to use standardized containers having predefined projections which interfit in corresponding slots in adjacent containers to interlock the containers within the stack. However, typically such container construction necessitates that each container individually be lifted into a position of precise registry with the lower container before being rested thereon so that the projections and slots register with each other. However, in actual practice many of the containers are partially or entirely positioned by sliding on the lower container and against the projections. This practice damages the projections and frequently tears the containers. Commonly the containers do not reach the position of registry for which they were designed.

Therefore, it has long been known that it would be desirable to have a container and method for manufacture thereof in which the lid portions are provided with more supporting strength than has heretofore been possible, which permit the contents of a sealed container to be examined without opening or damaging the container, which produce a container having greater vertical strength than is conventionally the case at a cost which is consistent with that of conventional container; which dependably possess the predetermined configuration of their design within substantially closer tolerances, particularly on the load bearing portions thereof; and which have interlocking portions which can be slidably interfitted without damage to the containers or interlocking portions.

SUMMARY OF THE INVENTION

Therefore, it is an object of the present invention to provide an improved container and method for manufacture thereof.

Another object is to provide such a container and method which obviate many of the problems associated with conventional containers used in packing, shipping and storing fungible goods, and particularly perishable products such as fresh fruit, fresh vegetables and the like.

Another object is to provide such a container and method which produce a container which allows examination of the contents thereof without opening the container, breaking the seal thereof, or otherwise damaging the container.

Another object is to provide such a container and method which permit the lid portions of the container to be strengthened over conventional containers without in any respect departing from any advantages associated with conventional containers while at the same time preventing an influx of dust, dirt, pests and the like to the container through the lid portions.

Another object is to provide such a container and method which result in the production of the container having substantially greater strength at little or no increase in cost and, more particularly, having strengthened load bearing portions permitting a multiplicity of such containers to be stacked in palletized form reducing to an absolute minimum any possibility that the palletized stack will fail in any manner even during prolonged cold storage.

Another object is to provide such a container and method which permit the containers to be constructed within substantially closer tolerances such that the containers possess a regularity of form not heretofore achieved in the art.

Another object is to provide such a container and method which result in a container which possesses an interlocking capability, but which need not be lifted and positioned precisely for interlocking with an adjacent container.

Another object is to provide such a container and method which avoid the use of hot melt adhesives in the sealing of the lid portions thereof and the attendant problems associated therewith.

Another object is to provide such a container and method which result in the production of a container which readily reveals when it has been tampered with, but which can instantly be opened without any damage whatsoever to the container or to the contents thereof.

Further objects and advantages are to provide improved elements and arrangements thereof in an apparatus for the purposes described which is dependable, economical, durable and fully effective in accomplishing its intended purposes.

These and other objects and advantages are achieved in the container of the preferred embodiment having a housing enclosing an internal compartment and having a wall bounding the compartment having an opening therein; and substantially transparent means obstructing the opening permitting viewing of the contents of the compartment therethrough.

DESCRIPTION OF THE PREFERRED EMBODIMENT

Figure 1:
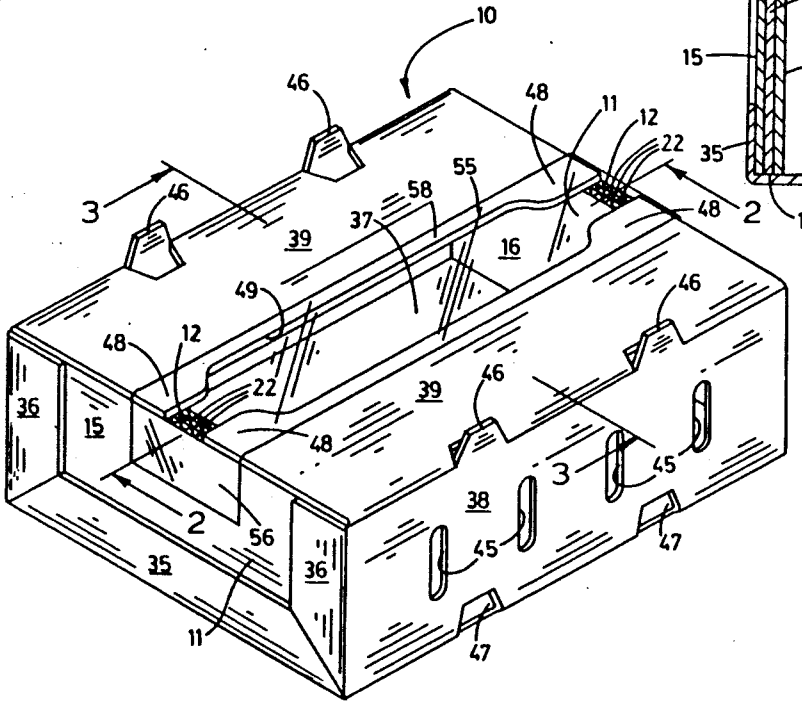
FIG. 1 is a perspective view of the container of the present invention.

Referring more particularly to the drawings, the container of the present invention is generally indicated by the numeral 10 in FIG. 1. While the container of the present invention can take a wide variety of forms, the container of the preferred embodiment has a variety of advantages believed well suited to the packing, shipping and storage of perishable goods such as fresh fruit, fresh vegetables and the like. It will, however, be understood that the container can be manufactured and employed in a variety of different forms for receiving a wide variety of different goods without departing from the invention hereof.

The container 10 has opposite end walls 11 which are substantially identical both in construction and size. Each end wall has an upper marginal edge 12, a lower marginal edge 13 parallel thereto, and opposite inner face 16, the terms "outer" and "inner" having reference to their respective positions in the container once manufactured. As will hereinafter be discussed in greater detail, the marginal edges 12 and 13 are substantially precisely right-angularly related to the opposite lateral edges 14. Similarly, the marginal edges 12 and 13 and the lateral edges 14 define substantially flat planes individually right-angularly related to the outer and inner faces 15 and 16.

Each opposite end wall 11 is constructed, in the preferred embodiment, of three corrugated panels 20 each having rectangular peripheral edges 21 coincident with their respective marginal edges 12 and 13 and lateral edges 14 of their respective opposite end walls. Each corrugated panel has a plurality of substantially parallel internal flutes 22 which, in assembled form, extend in right angular relation to and between the upper marginal edge 12 and the lower marginal edge 13 of the end wall 11. The panels are adhesively bonded together in facing engagement to form each end wall as heretofore described.

Figure 4:
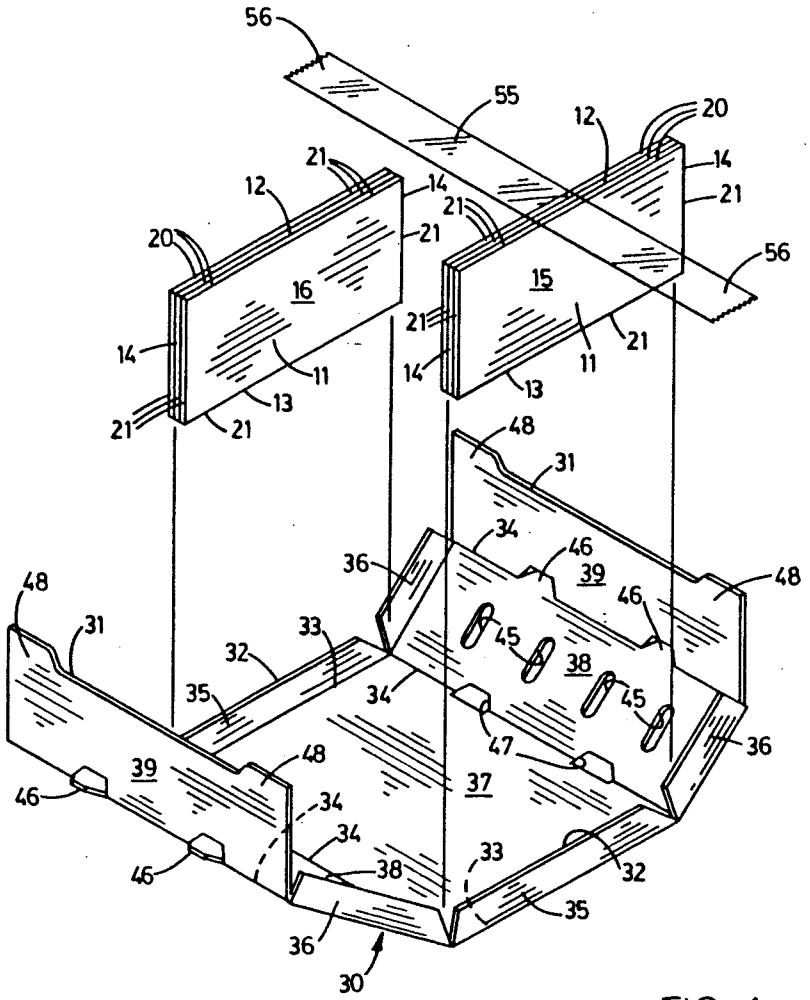
FIG. 4 is a perspective exploded view of the container of the present invention shown to illustrate the method for manufacture thereof of the present invention.

The container 10 has a container wrapper 30, best shown in FIG. 4. The container wrapper in the preferred embodiment is formed from a blank of corrugated cardboard material having opposite terminal edges 31 and opposite lateral edges 32. Lateral score lines 33 are formed in the wrapper and are interconnected by transverse score lines 34 extended therebetween in positions substantially right-angularly related to the lateral score lines. The lateral score lines form opposite bottom flaps 35 and opposite side flaps 36, extending outwardly therefrom, as can best be seen in FIG. 4. The transverse score lines define a rectangular bottom panel 37 of predetermined size, opposite side panels 38 and top or lid panels 39.

Figure 2:
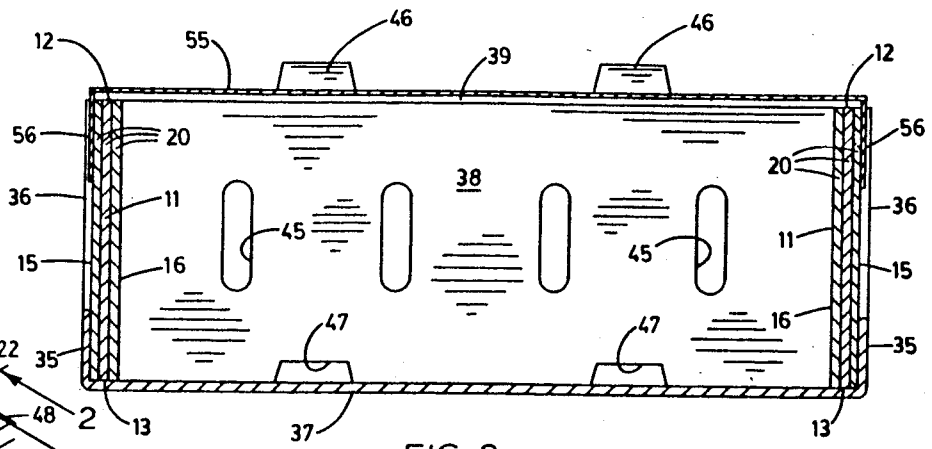
FIG. 2 is a somewhat enlarged, longitudinal, vertical section taken on line 2—2 in FIG. 1.
Figure 3:
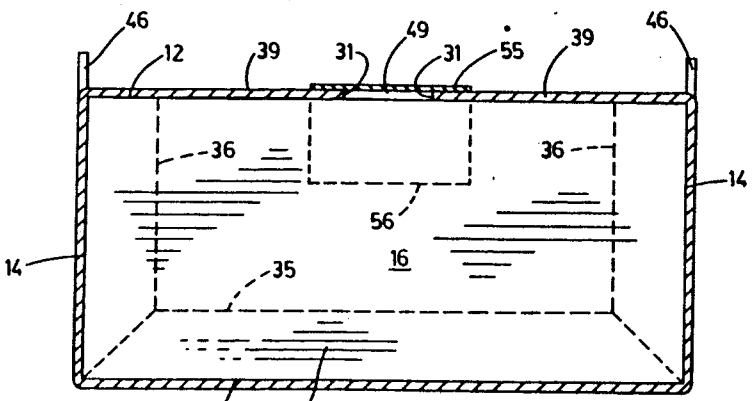
FIG. 3 is a somewhat enlarged, transverse, vertical section taken on line 3—3 in FIG. 1.

In the preferred embodiment of the container 10, the side panels 38 have a plurality of air vents 45 formed therein to allow air circulation to the contents of the container. The air vents have particular utility where the contents to be placed in the container may be perishable goods such as fresh fruit or fresh vegetables. The lid panels 39 are severed along courses to define projections 46 extending, in a packed and sealed container 10, upwardly at right angles to the sealed lid panels, as best shown in FIGS. 1, 2 and 3. Similarly, the side panels 38 and bottom panel 37 are severed in predetermined positions corresponding to the positions of the projections in the assembled container to form receptacles or slots 47 which extend through the score lines 34 between the bottom panel and the respective side panels, as best shown in FIG. 4. As will hereinafter be described in greater detail, in a stack of the containers 10 the projections of a lower container are adapted individually to interfit with the slots 47 of an upper container rested thereon so as to interlock the containers. Similarly, since the projections extend upwardly from the score lines 34 and the slots 47 extend through their respective score lines 34, the upper container can be slidably moved into place on the lower container so that the projections of the lower container interfit in the slots of the upper container. This is not possible in conventional container construction.

The lid panels 39 have convergent portions 48 which, in the assembled container 10, overlay the upper marginal edges 12 of the opposite end walls 11 in juxtaposition to each other. In the assembled and sealed container, the opposite terminal edges 31 of the wrapper 30 and the convergent portions 48 of the lid panels define a window opening 49, best shown in FIG. 1.

The container 10 in the assembled and sealed configuration employs a transparent band, preferably transparent pressure sensitive tape 55. The tape has opposite end portions 56, a lower adhesive surface 57 and an upper surface 58. As can best be seen in FIG. 1, in the sealed container 10 of the present invention, the opposite end portions 56 of the tape extend downwardly about the outer faces 15 of the end walls 11 and across the lid panels 39 in covering relation to the opposite terminal edges 31 and the convergent portions 48 of the lid panels.

OPERATION

The operation of the described embodiment of the present invention is believed to be readily apparent and is briefly summarized at this point.

The container 10 can be assembled at the main plant of the manufacturer requiring only that it be filled and sealed by the end user or packer. Alternatively, the container can be shipped in flattened, blank form to the end user and assembled at the site prior to such filling and sealing. In either case, the components of the container can be assembled using conventional assembly equipment to produce the container in the form as shown in FIG. 1 except that the lid panels 39 are not sealed and thus can be disposed in either opened or closed positions.

In both cases, the method for manufacture of the present invention calls for the opposite end walls 11 to be formed by sawing from a larger piece of such sheet material. The sheet material is composed, in the preferred embodiment, of three corrugated panels 20 adhesively bonded together so that the flutes 22 thereof are aligned in a common direction. This threeply sheet material can either be purchased in this form from a supplier or fabricated in the plant. Once the sheet material is formed as described, the end walls 11 are individually formed by sawing the sheet material along courses corresponding to the upper marginal edge 12, lower marginal edge 13 and lateral edges 14. The attitude of the saw during the sawing operation is at right angles to the outer face 15 and inner face 16 of the resulting end wall. This method for forming the end walls has been discovered not to crush or otherwise damage the flutes 22 of the corrugated panels comprising the end wall and to form precisely configured surfaces about which the wrapper 30 can be extended in accordance with the method of the present invention to form a container having substantially closer tolerances to the predesigned configuration and size for the container 10. The container wrapper 30 is constructed from a blank of corrugated cardboard which, in accordance with the method hereof, is severed along the opposite terminal edges 31 and the opposite lateral edges 32 while being scored along the lateral score lines 33 and transverse score lines 34, as shown in FIG. 4 to form the components of the wrapper heretofore described. Similarly, the wrapper is severed to form the air vents 45, projections 46 and slots 47.

As previously noted, the container 10 can be assembled further in the manufacturing plant or the wrappers 30 in flattened form and the end walls 11 can be bundled and shipped to the end user, typically a packer, for assembly there. In either case, the actual assembly of the components heretofore described to form an unsealed container is performed using conventional equipment well known in the art.

The end walls 11 of each container are placed in predetermined spaced relation so that the interior faces 16 of the end walls face each other. The wrapper 30 is subsequently extended about the end walls, as illustrated in FIG. 4, so that the side panels 38 individually facingly engage the lateral edges 14 of the end walls, the bottom panel 37 facingly engages the lower marginal edges 13 of the end walls and the lid panels 39 are left open. Adhesive is applied to the inner surfaces of the opposite bottom flaps 35 and the opposite side flaps 36 and the flaps are folded into facing engagement with the respective outer faces 15 of the end walls 11. Pressure is applied so that proper adhesion is achieved and an opened container is so formed.

Typically in a commercial operation, the containers 10 are packed with fresh fruit or fresh vegetables using conventional mechanical packing machines which fill the interior compartment of each container during passage along a packing line. In any case, the interior compartment of each container is filled with contents and, typically, the lid panels 39 are folded downwardly mechanically in such a machine. In any case, whether done manually, or mechanically, the lid panels are folded downwardly into facing engagement with the upper marginal edges 12 of the end walls 11. As shown in FIG. 1, the convergent portions 48 of the lid panels are thus disposed in juxtaposition, leaving the window opening 49 to expose the contents of the container.

Thereafter, manually or by any suitable mechanical equipment, a strip of transparent pressure sensitive tape 55 is extended across the lid panels 39 overlapping the opposite terminal edges 31 and across the window opening 49 in adhesive engagement with the lid panels. The opposite end portions 56 of the tape is folded downwardly into sealing engagement with the outer faces 15 of the end walls 11. This securely retains the lid panels in sealed condition while leaving the contents of the container visible through the tape as permitted by the window opening 49. The tape additionally improves the strength of the container over conventional containers in that a seal is formed entirely across the top of the container. Where the end user, or packer, has purchased the containers in assembled, opened condition, there is in addition no requirement for the use of hot melt adhesive in sealing the container since only the transparent pressure sensitive tape is employed for sealing the lid panels. This avoids all of the problems associated with the use of such hot melt adhesives. Still further, the use of the tape provides a seal serving as a barrier against the influx of dust, dirt, pests and the like through the top of the container.

The packed and sealed containers 10 are typically stacked in palletized form. When this is done, the projections 46 and slots 47 serve to interlock the containers in the stack. However, as previously noted, unlike conventional containers, the upper container being moved to an interlocking position can slidably be moved across the top of the lower container if desired. Since the projections extend upwardly from the sides of the container below, the upper container can slide therebetween, but once the projections are aligned with the slots 47, they will typically pop into position in their respective slots to interlock the containers. The transparent pressure sensitive tape 55 additionally serves to afford a low coefficient of friction to facilitate slidable positioning of the upper container on the lower container.

It has been found that the construction of the end walls 11 heretofore described composed of three adhesively bonded corrugated panels 20 having vertical flutes 22, substantially increases the strength of the container under vertical load and this is particularly important in a palletized stack permitting more of the containers to be stacked on top of each other. Since the end walls provide the main load bearing strength to the containers, the upper and lower marginal edges 12 and 13 thereof form precise planar surfaces normal to the end walls and the flutes 22 are vertically oriented, strength is substantially enhanced. Still further, sawing of the end panels during construction, prevents damage to the flutes which in conventional construction methods weakens the resulting container. Finally, the precise formation of the end walls using the sawing step heretofore set forth, produces a container which has much closer tolerances than has heretofore been possible. This, in itself, increases the strength of the resulting containers, particularly in a stack of the containers.

The containers 10 so packed and sealed, are capable of being stacked in cold storage for prolonged periods of time, shipped over great distances under adverse conditions, and otherwise serve to protect the contents to the maximum extend. Upon arrival at a destination point, anyone wishing to check the contents of the container for the quality and condition of the contents thereof can easily do so through the window opening without breaking the seal on the container. This is important where purchase is conditioned on the condition of the contents upon arrival. Such observation can be achieved without ever opening the container and so if the product is unacceptable it is quickly determined. In this way, some or all of the shipment can be rejected without in any way damaging the container or its contents.

Nonetheless, when it is desired to open the container 10, this is easily accomplished with a pocketknife, or even automobile keys by sliding the knife or key along the pressure sensitive tape 55 over the window opening 49 to slice the tape without in any way damaging the contents of the container. The tape is simply sliced longitudinally thereof and between the convergent portions 48 of the lid panels 39 and the upper marginal edges 12 of the end walls. This frees the lid panels 39 for opening and the container remains entirely intact. Should it be desired to seal the container again, this is simply accomplished by applying a new strip of pressure sensitive tape 55 across the lid panels and window opening to again seal the container. However, if the container has been tampered with, the severed portions of the original transparent pressure sensitive tape 55 will reveal that this has taken place, whether the container is again sealed or not.

Therefore, the container and method for manufacture thereof of the present invention provide a container in which the lid portions are provided with more supporting strength than has heretofore been possible; which permits the contents of the sealed container to be examined without opening or damaging the container; which produces a container having greater vertical strength than is conventionally the case at a cost which is consistent with that of conventional containers; which dependably possesses the predetermined configuration of the original design within substantially closer tolerances, particularly on the load bearing portions thereof; and which has interlocking portions which can slidably be interfitted without damage to the containers or the interlocking portions.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. A container comprising a housing enclosing an internal compartment and having a wall bounding said compartment formed by a pair of top panels of said housing overlaying the compartment and having marginal edges spaced from each other to define an opening; and substantially transparent means for obstructing said opening while allowing viewing of the contents of said compartment therethrough.

2. The container of claim 1 wherein said substantially transparent means is a transparent band overlaying said opening and adhesively attached to said wall.

3. The container of claim 1 wherein the housing has opposite end walls overlayed by said top panels and said substantially transparent means is a strip of transparent adhesive tape extending across said opening, about said end walls and adhesively attached to said top panels.

4. The container of claim 3 wherein said end walls are individually composed of a plurality of corrugated panels having internal flutes and adhesively bonded to each other with said flutes disposed in substantially right angular relation to said wall.

5. The container of claim 4 wherein each of the end walls has a marginal edge defining a plane substantially normal to said flutes of the corrugated panels.

6. The container of claim 5 wherein said housing has a pair of side walls substantially normal to said end walls and to said pair of top panels and said side walls individually have projections and receptacles individually on the lateral edges thereof adapted in a stack of said containers to interfit to retain said stack in releasably interlocked relation.

7. The container of claim 6 wherein said receptacles are formed in said housing individually extending about lower marginal edges of said side walls whereby the projections of one of said containers can be slidably interfitted in the receptacles of another of said containers.

8. A container for packing perishable goods and the like, the container comprising:

a pair of end walls disposed in spaced substantially parallel relation;

a wrapper extended about said end walls and adhesively attached thereto to form a bottom wall, a pair of spaced substantially parallel side walls and a pair of top panels respectively movable between opened positions and closed positions and having marginal edges adapted to be extended toward each other in said closed positions in spaced relation to the bottom wall to define a compartment for said container and said marginal edges spaced from each other in said closed positions to define a window opening communicating with said compartment; and a band of substantially transparent material, after filling of said compartment, adapted to be extended across said top panels in said closed positions in a sealing position overlaying said window opening substantially to seal the container thereacross while permitting viewing of the contents of the compartment.

9. The container of claim 8 wherein said end walls are each composed of a plurality of adhesively interconnected corrugated panels having flutes disposed substantially normal to the bottom wall of said wrapper to impart enhanced strength to the container along an axis parallel to said flutes.

10. The container of claim 9 wherein each of said end walls has opposite longitudinal edges defining planes substantially normal to said flutes for enhanced strength.

11. The container of claim 10 wherein the band in said sealing position extends downwardly onto and is adhesively attached to the end walls.

12. The container of claim 11 wherein said marginal edges of the top panels converge adjacent to the end walls on opposite sides of the window opening for enhanced strength.

13. The container of claim 9 wherein three of said corrugated panels are adhesively interconnected to form each of said end walls.

14. The container of claim 8 wherein each of the end walls is substantially rectangular having corners whereby corresponding corners of the end walls define substantially parallel lateral edges for said side walls extending therebetween and one of said lateral edges of each side walls has projections extending from said lateral edge in a plane substantially parallel to the side wall and the other of said lateral edges of each side wall has corresponding receptacles disposed for releasably interlocking with the projections of an adjoining container in a stack of said containers.

15. The container of claim 14 wherein said receptacles of the side walls extend about the lateral edges of the side walls and into said bottom wall whereby said containers can be moved into releasably interlocking stacked relation to each other by slidable movement relative to each other.

16. A method for manufacturing a container comprising the steps of forming a pair of end walls;

positioning said end walls in spaced, substantially parallel relation to each other;

extending a wrapper, having lid portions, about said end walls in adhesive attachment thereto with said lid portions respectively positionable in opened positions for filling the container and in closed positions having portions disposed in spaced relation to each other to define an opening; and after filling the container as formed, sealing said container by extending a substantially transparent strip of tape across said lid portions and the opening to retain the lid portions in the closed positions and forming a window for the container through which to view the contents thereof through the opening.

17. The method of claim 16 wherein the forming step includes adhesively bonding a plurality of corrugated panels in facing relation to each other to form said end walls with the flutes thereof disposed in substantially parallel relation to each other.

18. The method of claim 17 including, following said forming step, the step of sawing said end walls from a sheet of adhesively bonded corrugated panels along courses substantially right-angularly related to each other and in planes substantially normal to said panels to form end walls having end surfaces substantially normal to said panels whereby, in said extending step, said wrapper and end walls are combined to form a container of enhanced strength.

19. The method of claim 18 wherein said positioning step includes disposing said end walls so that said flutes thereof are disposed in substantially right angular relation to the lid portions after sealing in said sealing step.

* * * * *

UNITED STATES PATENT AND TRADEMARK OFFICE

CERTIFICATE OF CORRECTION

PATENT NO. : 5,039,005

DATED : August 13, 1991

INVENTOR(S) : Max L. Flaming

It is certified that error appears in the above-identified patent and that said Letters Patent is hereby corrected as shown below:

Column 4, line 19, insert the words --lateral edges 14. Each end wall has an outer face 15 and an-- after the word "opposite".

Signed and Sealed this

Seventeenth Day of November, 1992

*Attest:*

DOUGLAS B. COMER

*Attesting Officer*

*Acting Commissioner of Patents and Trademarks*